US005852759A

United States Patent [19]

Vackier et al.

[11] Patent Number: 5,852,759

[45] Date of Patent: Dec. 22, 1998

[54] ELECTROSTATOGRAPHIC DEVELOPING DEVICE WITH TONER DOSAGE RESERVOIR

[75] Inventors: Leo Vackier, 's Gravenwezel; Paul Konings, Westerlo; Luc Van Goethem, Sint-Gillis-Waas, all of Belgium

[73] Assignee: Agfa-Gevaert, Mortsel, Belgium

[21] Appl. No.: 858,908

[22] Filed: May 19, 1997

[30] Foreign Application Priority Data

May 17, 1996 [EP] European Pat. Off. ..... 96201387

[51] Int. Cl.[6] ..... G03G 15/08

[52] U.S. Cl. ..... 399/260; 399/224; 399/258; 22/DIG. 1

[58] Field of Search ..... 399/258, 260, 399/262, 223, 224, 226, 103, 104, 102, 112, 227; 222/DIG. 1

[56] References Cited

U.S. PATENT DOCUMENTS

| | | | |
|---|---|---|---|
| 3,572,551 | 3/1971 | Gillespie et al. | 222/DIG. 1 |
| 3,572,555 | 3/1971 | Knight et al. | 222/DIG. 1 |
| 4,261,290 | 4/1981 | Yamashita et al. | 399/254 |
| 4,377,334 | 3/1983 | Nishikawa | 399/103 |
| 4,647,180 | 3/1987 | Watanabe | 399/258 |
| 4,932,355 | 6/1990 | Neufeld | 399/257 |
| 4,967,691 | 11/1990 | Chikama et al. | 399/62 |
| 5,142,333 | 8/1992 | Verbeek et al. | 399/256 |
| 5,768,662 | 6/1998 | Sugihara | 399/258 X |

*Primary Examiner*—Matthew S. Smith
*Attorney, Agent, or Firm*—Baker & Botts, L.L.P.

[57] ABSTRACT

An electrostatographic developing device (15) including a magnet roller (16), a chamber (41) for two-component developer, a holder (22) for toner and a toner dosage reservoir (45) with an opening closed by a magnetic plug (58) of developer, and a magnet (53) for controlling such magnetic plug.

16 Claims, 12 Drawing Sheets

ELECTROSTATOGRAPHIC DEVELOPING DEVICE WITH TONER DOSAGE RESERVOIR

DESCRIPTION

1. Field of the Invention

This invention relates to electrostatography, and more in particular to the replenishment of toner that is consumed by the development of an electrostatic charge image by means of a two-component dry-powder developer.

2. Background of the Invention

In electrostatography a latent image is formed by (i) applying an imagewise charge distribution to a dielectric, (ii) developing the latent image, i.e. converting it into a visible image by depositing thereon selectively light-absorbing particles, called toner particles. The toner particles are mostly electrically charged. The image, made visible by the deposition of toner particles on the latent image that was present on the dielectric, is then transferred to a substratum and fixed thereon to yield the final copy. In electrophotography, which is a special embodiment of electrostatography, the dielectric is a photoconductor and an image is formed by (i) uniformly charging a photoconductor, (ii) imagewise discharging it so as to obtain a latent image, (iii) developing the latent image, i.e. converting it into a visible image by depositing toner particles on the latent image. The image, made visible by the deposition of toner particles on the latent image that was present on the photoconductor, is then transferred to a substratum and fixed thereon so as to yield the final copy.

For the application of toner development two methods are known "dry-powder" and "liquid-dispersion" development. At present the dry-powder method is the most commonly used. More details on the dry-powder development can be found a.o. in IEEE Transactions on Electronic Devices, Vol. ED-19, no. 4, April 1972, pp. 495–511.

In the dry-powder process the toner particles are charged triboelectrically by mixing them, viz. shaking them together with the carrier particles (toner and carrier particles have an opposite charge). The mixture of carrier particles and toner particles that are attracted electrostatically by the carrier particles, is the developer.

During development the toner particles are released by the carrier particles and deposited on the charge image that is present on a dielectric. The toner particles are thus the consumable in the developer. This implies that the developer gets exhausted upon being used, i.e. the concentration of toner particles gets smaller as development goes on. A continuous development process, therefore, requires regular addition of toner. These fresh toner particles are still uncharged and are mixed (shaken) again in the apparatus with the carrier particles for charging them triboelectrically.

The addition of toner to the used developer must occur in a reliable way with a known amount. The amount and timing are mostly controlled by an overall process control algorithm. The process controller is choosing the amount and timing in a way that gives the best overall engine performance and stability.

There are several toner addition systems known in the art. The most common system consists of a helical feed screw and a toner reservoir. Rotation of the feed screw in an appropriate housing causes transport of toner along the screw axis, the outlet of the system leading to the developer mass of the system, or to another feed screw.

This system shows the following disadvantages.

Clogging of a flow of particles is a known physical process which also applies to toner flow. This makes it necessary to provide extra stirring means which adds to the mechanical complexity.

Because of the above-mentioned clogging, the exact filling degree of the feed screw is not known. This has a negative impact on the predictability of the amount really added, which is disturbing the proper functioning of a process control algorithm and which is also a source of image density uncertainty.

Because a mechanical system is acting on the toner particles, it may result in toner quality degradation such as clustering of toner particles or deformation or breaking of them.

Such a system is completely unsatisfactory in certain specific implementations e.g. when the toner addition system belongs to a developing unit which is used in a carousel rotating in a vertical plane. In that situation the added amount is strongly influenced by the motion of the carousel. At standstill of the feed screw rotation of the housing around the feed screw can even cause toner transport in a reverse direction.

Another known system comprises a toner reservoir, the bottom opening of which is closed by means of a roller having a resilient covering of foam rubber or the like with open cell structure. Rotation of the roller removes a predetermined amount of toner from the reservoir at each revolution, the removed toner falling from the roller in the developer that should be refreshed.

Because the foam rubber roller rubs against walls with toner in between, high mechanical loads are put on the toner which result in toner quality degradation.

The foam rubber itself may degrade and loose particles in the developer which can be extremely dangerous, especially if these lost particles get trapped behind the doctor blade controlling the thickness of the developer layer on the magnet roller, which would necessitate an immediate replacement or cleaning of the developing unit.

U.S. Pat. No. 4,647,180 discloses a toner reservoir which is filled with toner to a level located above its upper edge so that the toner overflows the reservoir. The dosing as such, however, occurs by means of a roller instead of by the reservoir.

SUMMARY OF THE INVENTION

Objects of the Invention

It is an object of the invention to provide a toner addition system which allows accurately known amounts of toner to be added to a depleted developer.

It is a further object of the invention to provide a toner addition system that does not necessarily require a helical feed screw or other active transport means so that the toner can be treated very gently, e.g. by gravity, whereby its degradation as described hereinbefore does not occur.

Statement of the Invention

In accordance with the present invention, an electrostatic developing device comprising a magnet roller, a chamber for two-component developer, a holder for toner and means for adding toner from its holder to used developer to produce fresh developer, is characterised in that said means for adding toner comprises a dosage reservoir, means for overfilling said dosage reservoir with toner so that an amount of toner overflows the top of the dosage reservoir while leaving a pile of toner on its top, and means for emptying said dosage reservoir in the developer chamber.

The mentioned arrangement offers an accurate and reproducible toner addition control, which spares the toner.

Suitable embodiments of a device according to the invention are as follows.

The means for filling the dosage reservoir comprises means for moving said dosage reservoir upwardly through a supply of toner. Such means can cause the dosage reservoir to follow a circular path located in a vertical plane. One embodiment of such arrangement is a housing rotatable about a horizontal axis, such housing comprising a magnet roller, a chamber for developer, a holder for toner, and a dosage reservoir mounted within the holder for toner.

The dosage reservoir can in such embodiment be mounted in the toner holder on a wall which is common with the developer chamber, an opening in the dosage reservoir allowing toner to flow from the reservoir into the developer chamber under the control of a valve. Such valve can suitably be formed by a magnetic plug of developer kept in place by a magnetic field traversing the outlet opening of the developer reservoir. Developer for use with a magnet development roller has anyhow ferromagnetic properties in order to allow a magnetic brush to be established on the magnet roller.

According to a further embodiment, two or more toner reservoirs are provided in parallel so that different replenishing dosages can be added to the developer by appropriate control of the reservoirs. If the contents of such reservoirs are different, a plurality of dosage combinations can be obtained.

BRIEF DESCRIPTION OF THE DRAWINGS

The invention will be described hereinafter by way of example with reference to the accompanying drawings, wherein.

DETAILED DESCRIPTION OF THE INVENTION

Figure 1:
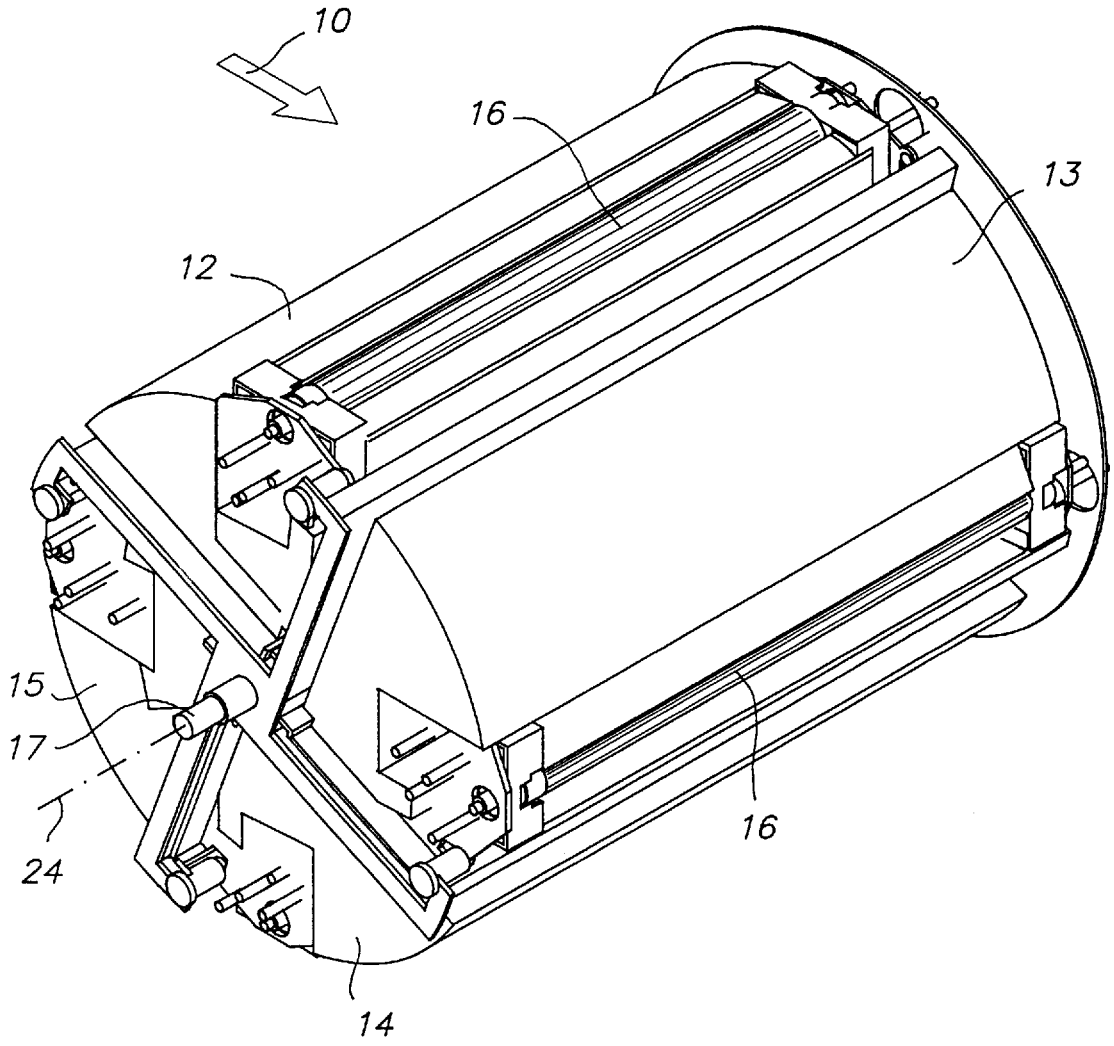
FIG. 1 is an isometric view of a carousel-like electrostatic development arrangement incorporating one embodiment of a device according to the present invention.

FIG. 1 shows an embodiment of an electrophotographic developing assembly 10 which generally has the form of a carousel in which four identical developing devices 12, 13, 14 and 15 are mounted in angular relationship. Means is provided, not shown, for causing a support bearing an electrostatic charge image, e.g. the peripheral surface of a photoconductor drum, to follow a path that is close to the carousel at a given area opposite to a magnet roller, such as the magnet roller of device 15, so that at such position development of the charge image can occur with developer supplied by the magnet roller. The carousel can then be rotated on shaft 17 over 90 degrees and the support provided in the meantime with another charge image can then be developed by the next magnet roller with another developer, etc. More specifically, the arrangement allows the production of a colour toner image by the successive development with a cyan, a magenta, a yellow and a black and white developer. The toner image thus produced can be transferred to a final carrier, e.g. a sheet of paper, and next be fixed by means of heat and/or pressure, all as known in the art.

The driving means for rotating the carousel and the respective magnet rollers and feed screws of the four developing devices have not been shown as they are not required for understanding the principle of operation of the present embodiment of the invention.

The four developing devices are clamped by appropriate clamps in the frame mechanism of the carousel and are easily removable for filling with developer, with toner, for servicing, or for simple replacement by another one in the case of disposable devices.

Figure 2:
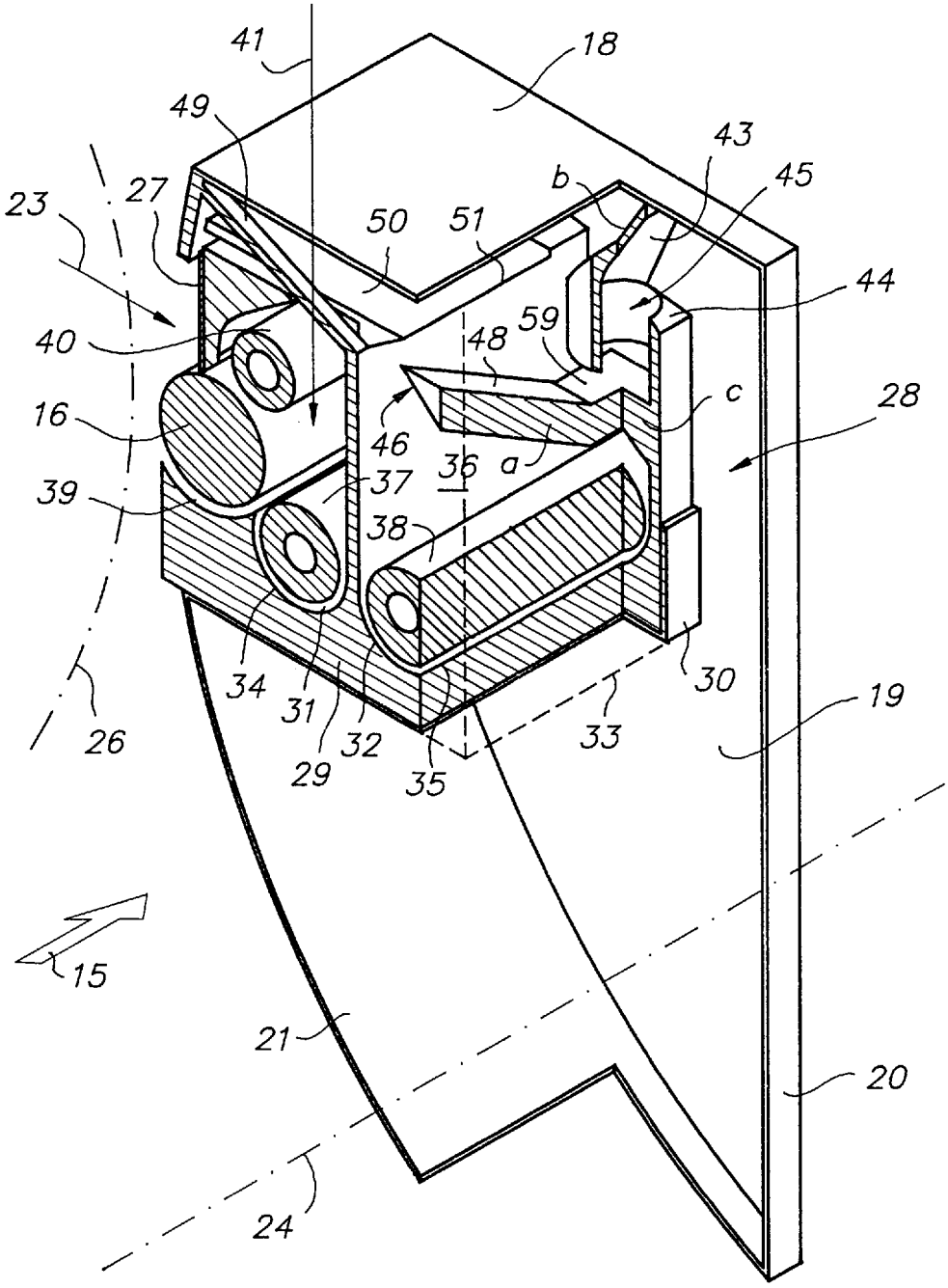
FIG. 2 is an isometric view, partly broken away, of one developing device of the carousel of FIG. 1.

FIG. 2 is a vertical sectional view of developing device 15 of FIG. 1, partly broken away.

Device 15 is mounted in a housing with a generally wedge-like shape, with a flat top wall 18, two flat end walls such as wall 19 shown, an inside wall 20 and a cylindrically curved outside wall 21. Outside wall 21 has a peripheral slot 23 running parallel to the axis of rotation 24 of the device, and a magnet roller 16 is mounted rotatably in the device, its periphery protruding slightly beyond the boundary of wall 21. The path of a support carrying an electrostatic charge is indicated schematically by curved line 26, it being understood that such path passes at a small distance from magnet roller 16 to allow brushing contact of a layer of developer on the roller with such support. A doctor blade 27 governs the thickness of the layer of developer adhering to the magnet roller.

The device comprises a developing assembly 28 mounted in the upper end of device 15. The remaining internal volume of housing 15 forms a holder 22, see FIG. 3, for a supply of toner which will be used for replenishing used developer.

Developer assembly 28 comprises a bottom wall 29 with uniform cross-section along its length, a rear wall 33 as shown in dashed lines, and two end walls 30, one only being visible in the drawing. Wall 29 has two feed passages 31, 32 formed by concave bottom curvatures 34, 35, and an upright partition wall 36 separating both passages. Said wall has a bottom opening (not shown) near both its lateral ends through which the corresponding ends of the two feed passages communicate with each other. Two helical feed screws 37 and 38 are rotatably journaled in the feed passages and rotate in opposite directions whereby developer circulates from one feed passage to the other through the respective end openings, and thereby is mixed and stirred. A third curvature 39 defines with magnet roller 16 a gap for return of used developer by means of the magnet roller.

A device as described hereinbefore is known in the art, and a more detailed described can be found e.g. in U.S. Pat. No. 5,142,333. A third helical feed screw 40 in developer chamber 41 applies developer to the magnet roller.

Rear wall 33 extends upwardly to top wall 18 of the device. The illustrated hatched surfaces a, b and c all belong to said rear wall. End wall 30 has a dosage reservoir 45 formed by a cylindrical vertical cavity. The top rim of the toner reservoir has a downwardly sloping rim 44. A curved wall 43 circumscribes a portion of the entry of the dosage reservoir and extends up to top wall 18 and lateral wall 19.

A wedge-like bar 46 with inclined top surface 48 is fitted to the inside surface of rear wall 33 (see surface a). The length of this bar in a direction parallel to the axis of feed screw 38 is a fraction only of the length of the screw.

Developer chamber 41, which in fact comprises the spaces at both sides of wall 36 since they communicate with each other via the bottom openings, is closed on its upper side by two inclined walls providing slide surfaces 49 and 50 extending from partition wall 36 up to curved front wall 21 (above slot 23). Surface 49 is notably steeper than surface 50. Surface 50 has a lip-like extension 51 whereby it protrudes beyond wall 36. The width of slide surface 50 (i.e. parallel to feed screw 38) corresponds generally with the width of bar 46, whereas surface 49 extends from surface 50 up to the opposite end of this feed screw.

Figure 3:
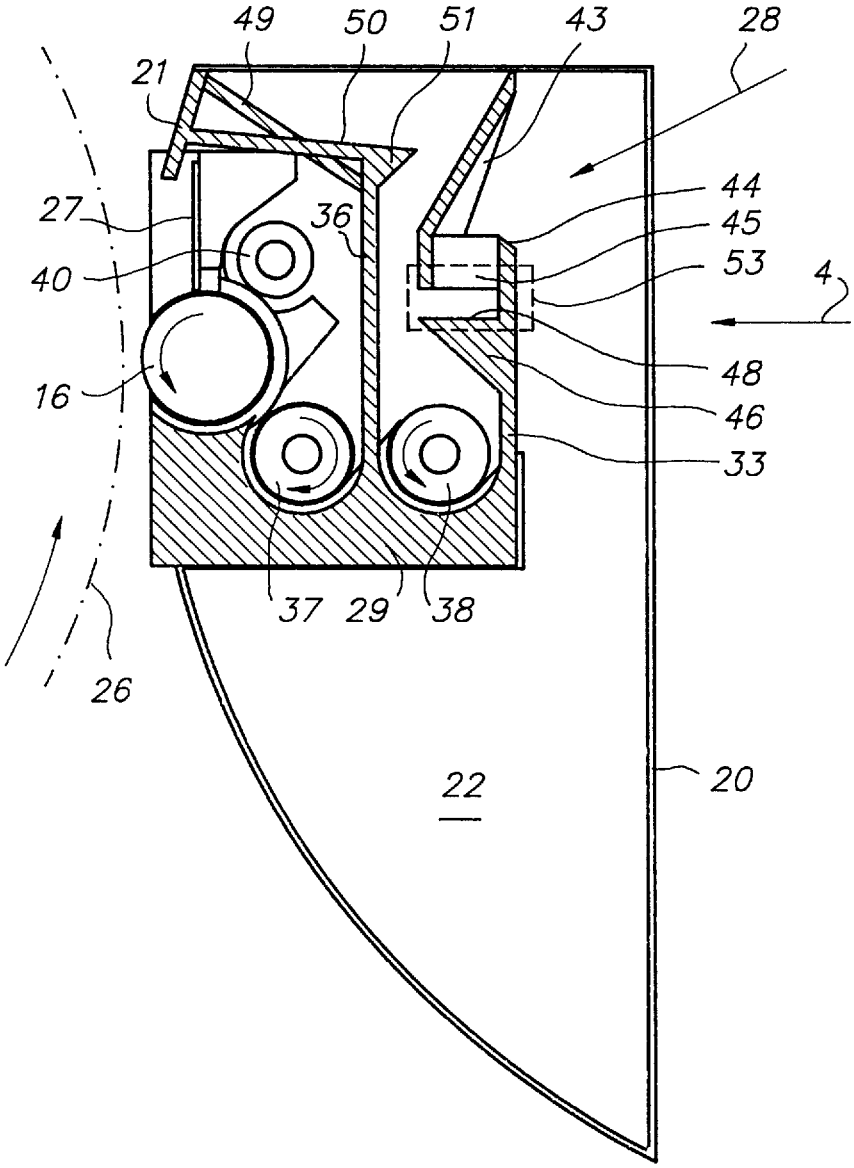
FIG. 3 is a diagrammatic cross-sectional representation of the device of FIG. 2 while in its development position, and while empty.
Figure 4:
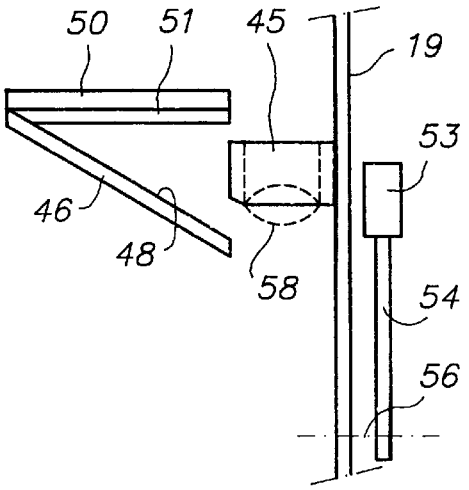
FIG. 4 is a diagrammatic partial view according to arrow 4 of FIG. 3.
Figure 5:
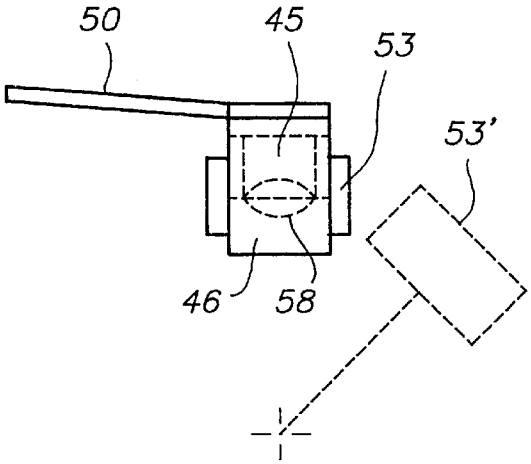
FIG. 5 is a lateral view of FIG. 3.

FIG. 3 is a diagrammatic vertical cross-sectional representation of the device of FIG. 2 which will be used hereinafter to explain the operation of the device. FIGS. 4, 5 and 6 are diagrammatic sectional views showing details of the dosage reservoir of FIG. 3.

FIG. 4 is a diagrammatic view in a vertical plane according to arrow 4 of FIG. 3, showing slide surfaces 48 and 50, dosage reservoir 45, lateral wall 19 of the device and a permanent magnet 53. Permanent magnet 53 is fitted on an arm 54 which is pivotable at axis 56 on side wall 19. The magnet bodily rotates together with the complete device about axis 24 of the carousel, see FIG. 2. Magnet 53 can be swung from a position in close proximity to the dosage reservoir, as shown in full lines in FIG. 5 which is a view in a plane normal to the axis of screw 38, to a distal one as shown in dashed lines 53'. The magnetic field of the magnet in the proximal position traverses wall 19 and also the wall of the dosage reservoir so it is capable of forming and sustaining a magnetic plug 58 of developer at the outlet opening of the dosage reservoir, as indicated in dashed lines. The plug will be released only at the moment toner addition is required. This moment is controlled by movement of magnet 53 from its proximal to its distal position so that the magnetic field becomes too weak to maintain the magnetic plug any longer. Control of the change of the magnet position can occur by any means known in the art such as a cam follower riding on a stationary cam track, a solenoid or any other suitable lever mechanism.

Figure 6A:
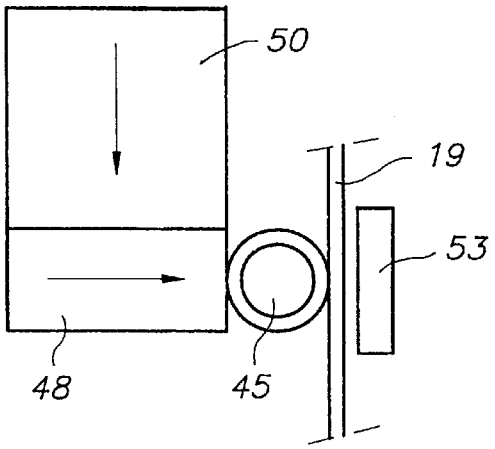
FIG. 6*a* is a top view of FIG. 3
Figure 6B:
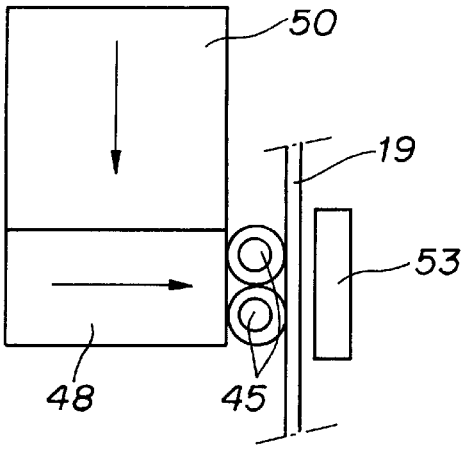
FIG. 6*b* is a top view of FIG. 3 in an embodiment where a plurality of dosage reservoirs are present.

FIG. 6*a* is a top view showing slide surfaces 48 and 50, the entry opening of dosage reservoir 45 and permanent magnet 53. The arrows on the slide surfaces indicate the directions of motion of the developer which are at a right angle to each other. Whereas FIG. 6*a* shows the slide surfaces, the motion of the developer to the dosage reservoir and the permanent magnet for an embodiment with a single dosage reservoir, FIG. 6*b* depicts the same but for the embodiment of a plurality of dosage reservoirs.

The operation of the device will now be described with reference to FIGS. 7 to 14 which show consecutive angular positions of the device during its rotation over 360 degrees about axis 24.

Figure 7:
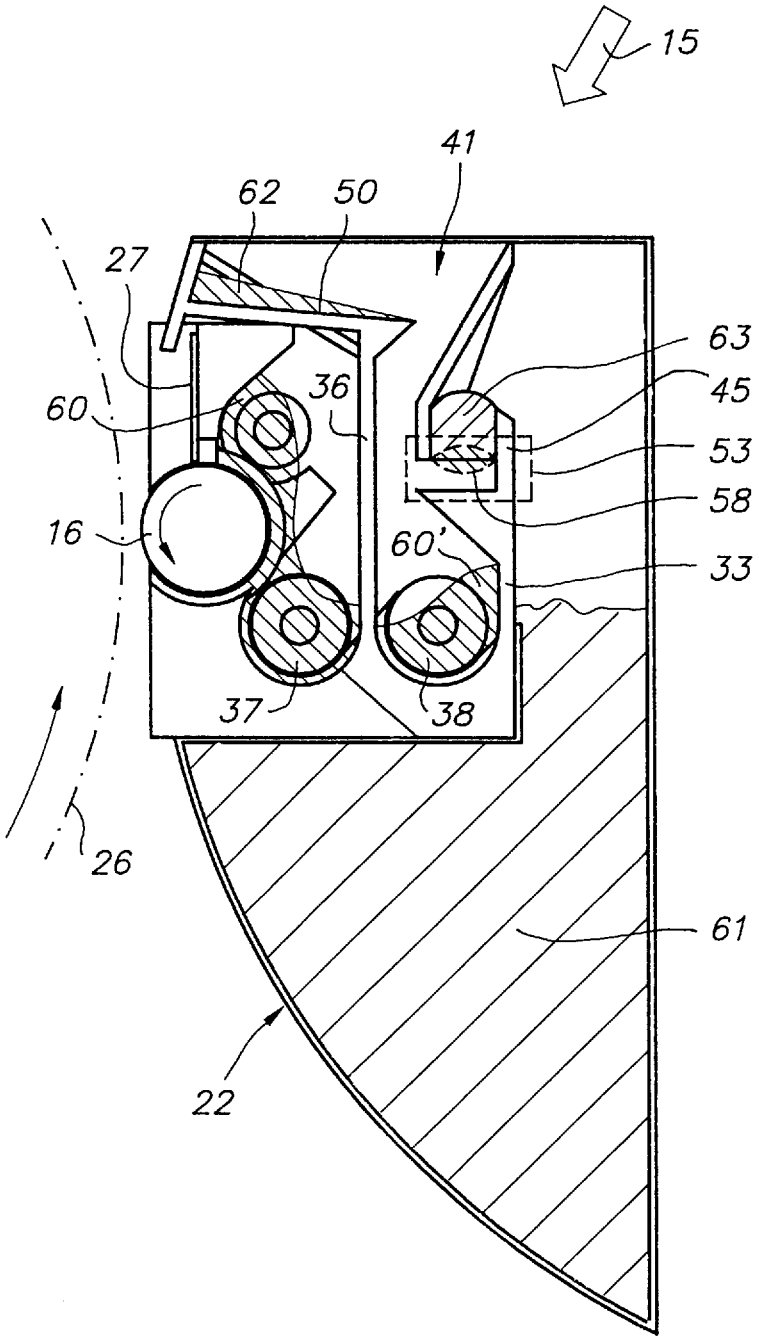
FIG. 7 is the same diagrammatic view of FIG. 3, the device being filled however with toner and developer.

The device being in the developing position as shown in FIG. 7, developer 60 in developing chamber 41 and the toner 61 in toner holder 22 occupy a position as shown by the hatched portions of the drawing. It should be understood that developer 60' in the chamber section of feed screw 38 belongs in fact to the mass 60 since this section is in communication with the one at the opposite side of wall 36 as explained already.

Rotating magnet roller 16 is covered with a layer of developer which causes development of a support bearing an electrostatic charge image which is conveyed along path 26 past the magnet roller.

A wedge-like layer 62 of developer lies on slide surface 50, whereas dosage reservoir 45 is filled with a dose 63 of toner, magnetic plug 58 keeping the reservoir closed.

Toner which has been consumed during the development is replaced as follows.

Figure 8:
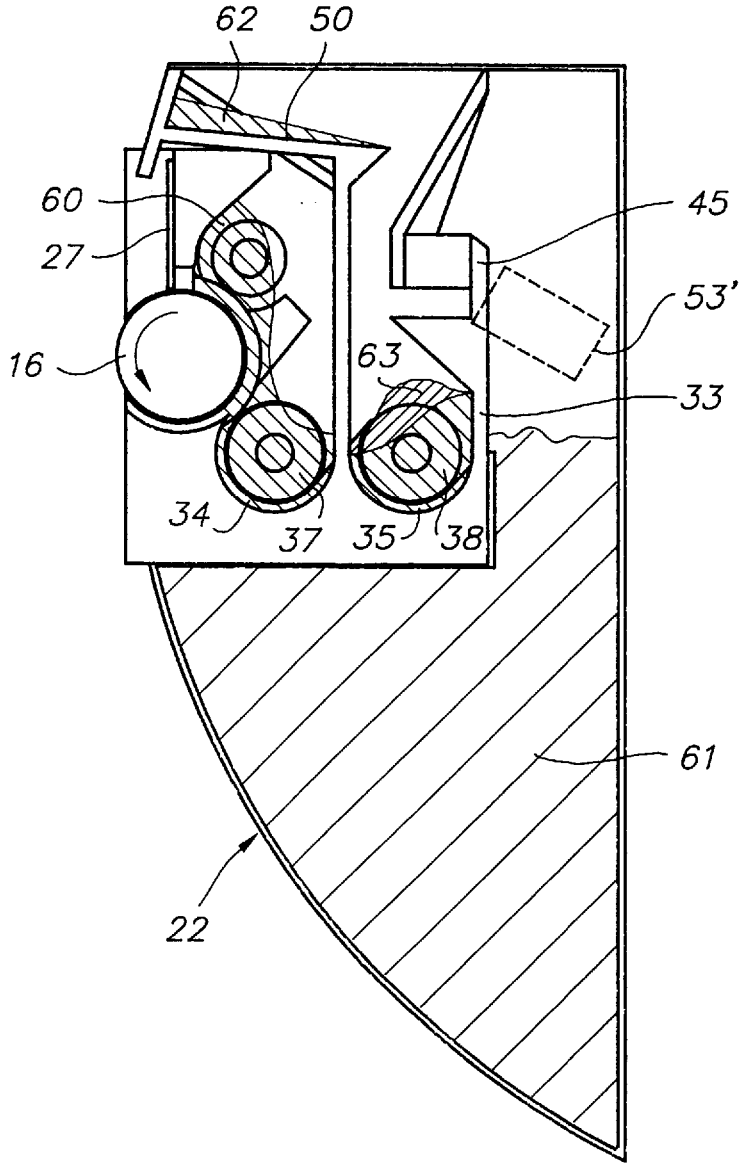
FIG. 8 shows the device of FIG. 7 while, however, the magnet controlling the dose reservoir is in a distal position.

Magnet 53 is briefly swung away as indicated by dashed lines 53' in FIG. 8 so that the magnetic developer plug of the dosage reservoir falls down on feed screw 38, together with the volume of toner restrained thereby. Feed screw 38 transports the added volumes of toner and developer axially through feed passage 35 up to the bottom opening in partition wall 36 which brings this toner and developer in the adjacent feed passage 34 in which feed screw 37 feeds them in opposite direction to the other bottom opening of wall 36, and so back to feed screw 38. The mentioned circulation causes the added toner to become sufficiently triboelectrically charged and uniformly distributed along the length of the screws. Magnet roller 16 picks up from feed screw 37 a portion of the developer which then is additionally mixed by feed screw 40 and metered by doctor blade 27.

As the electrostatic image has been developed, carousel 10 is clockwise rotated over 90 degrees to bring developing device 14 in the place of device 15.

Figure 9:
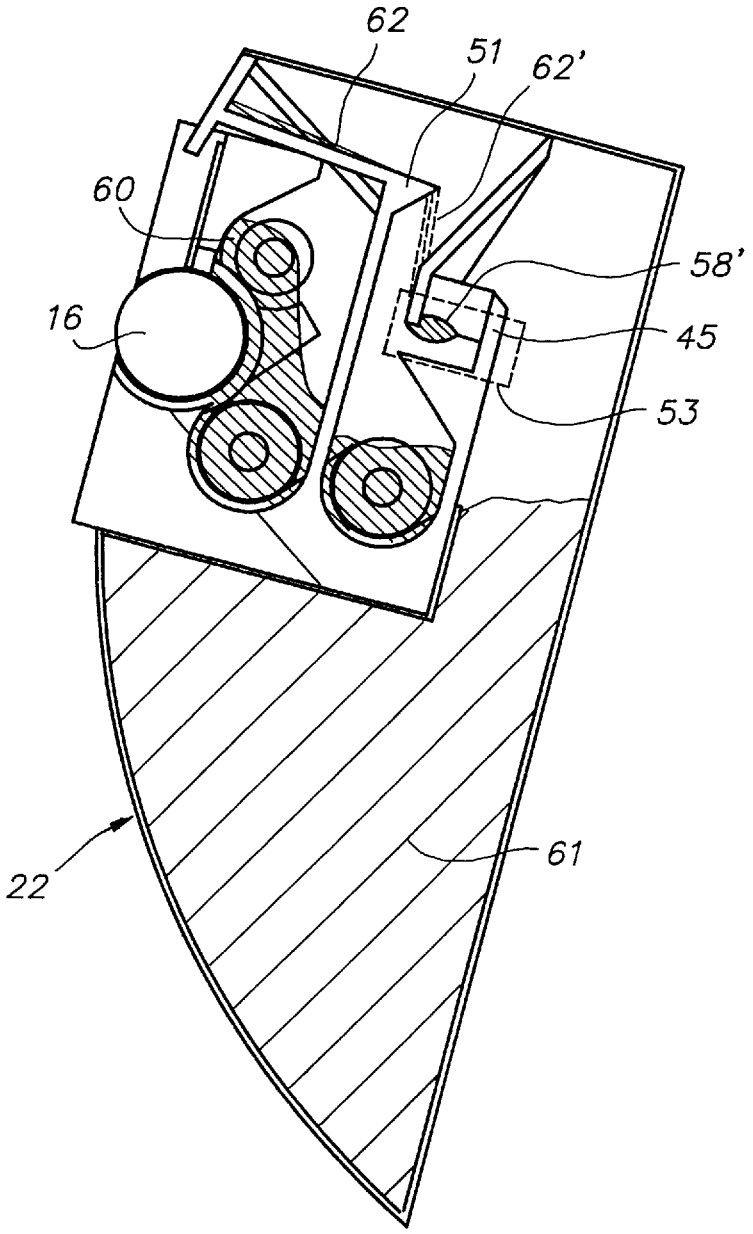
FIG. 9 shows the device of FIG. 7 while rotated to move through an angle of approximately 10 degrees.
Figure 10:
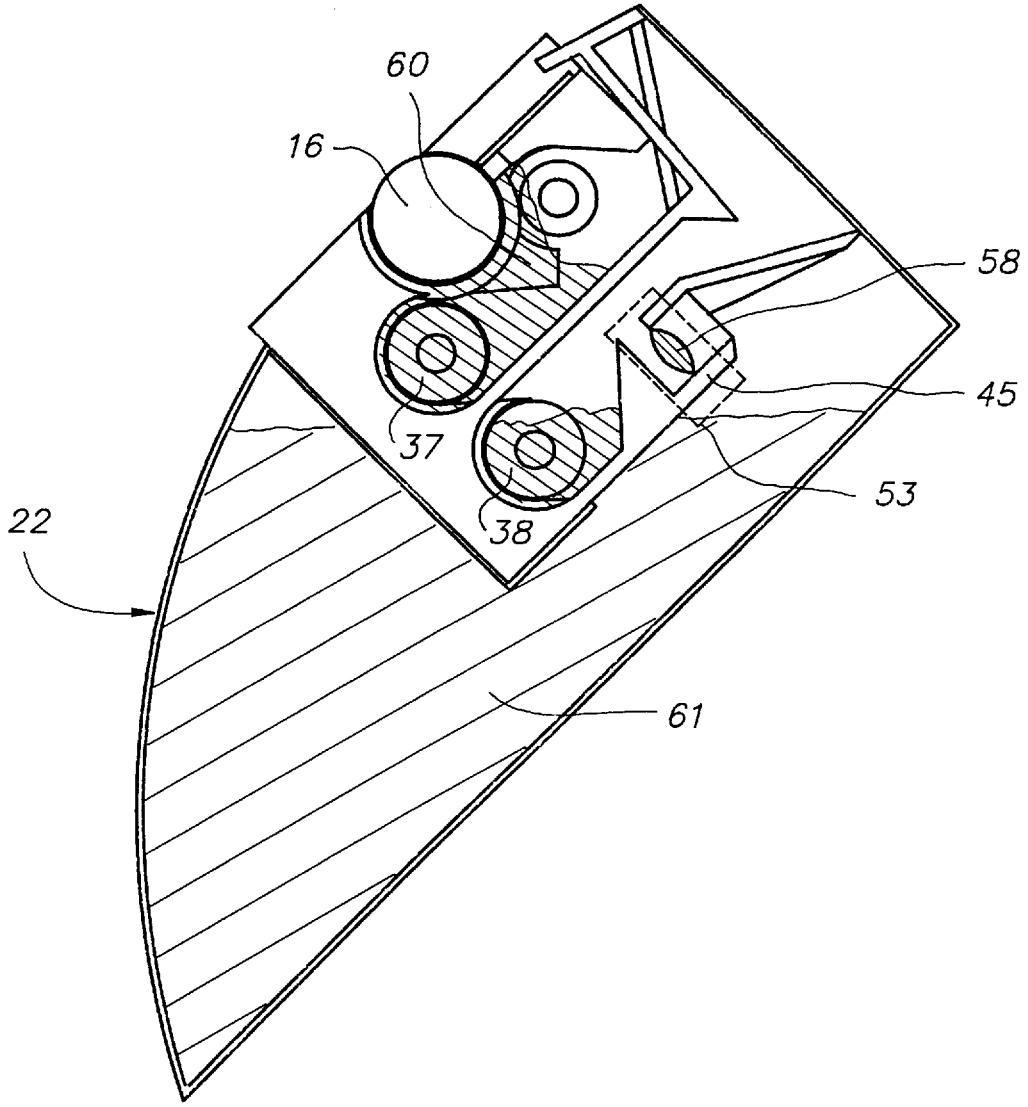
FIG. 10 shows the device of FIG. 7 while rotated over 45 degrees.

After a rotation of device 15 over approximately 15 degrees, see FIG. 9, developer 62 on slide surface 50 starts to slide downwardly since its frictional resistance is no longer capable of keeping it in place. Developer overflows lip 51 over the full width of this lip and flows as 62' downwardly on slide surface 48 of bar 46, see FIG. 2. The developer instantly flows to a position on surface 59 right under the bottom opening of dosage reservoir 45 where the magnetic field of magnet 53 initiates, see 58', the formation of a magnetic plug at the outlet opening of the dosage reservoir since the ferromagnetic carrier particles of the developer are attracted by the magnetic field in this region. Developer that is not used for the magnetic plug remains on surfaces 48 and 59 and will later fall on feed screw 38. Complete plug 58 is shown in FIG. 10. Magnet 53 maintains its proximal position since its swinging away to release the toner dose was very briefly only.

The position of the device after a rotation over 45 degrees is shown in FIG. 10.

Figure 11:
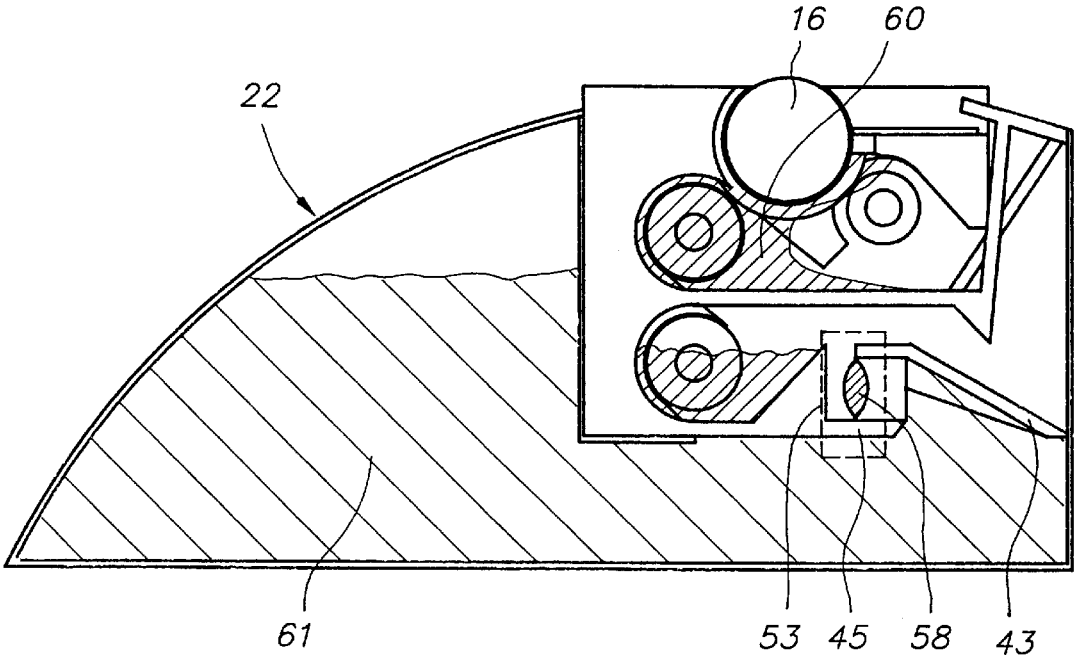
FIG. 11 shows the device of FIG. 7 while rotated over 90 degrees.

The position after a rotation over 90 degrees is shown in FIG. 11. The mass of toner 61 has reached the entry opening of dosage reservoir 45 and starts to fill the reservoir. Magnetic plug 58 keeps the outlet of the reservoir closed.

Figure 12:
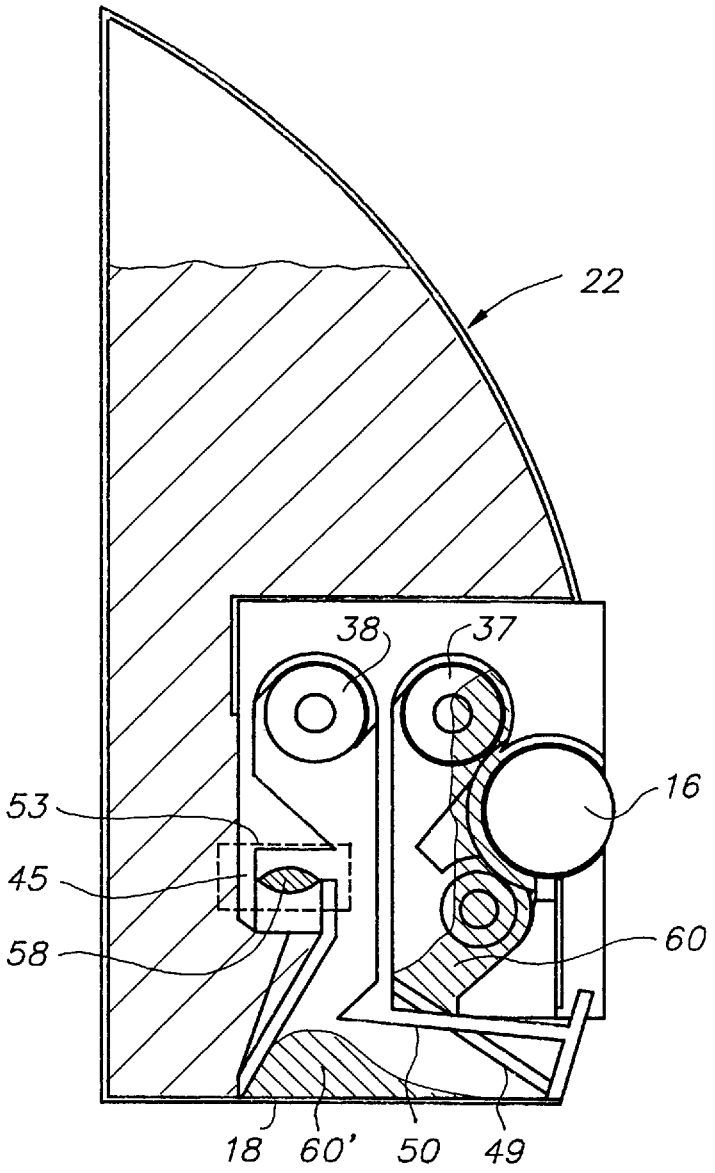
FIG. 12 shows the device of FIG. 7 while rotated over 180 degrees.

FIG. 12 shows the position of the device after 180° rotation. Developer 60' of feed screw 38 flows on top wall 18 and enters the space between this wall and adjacent slide surfaces 49 and 50.

Figure 13:
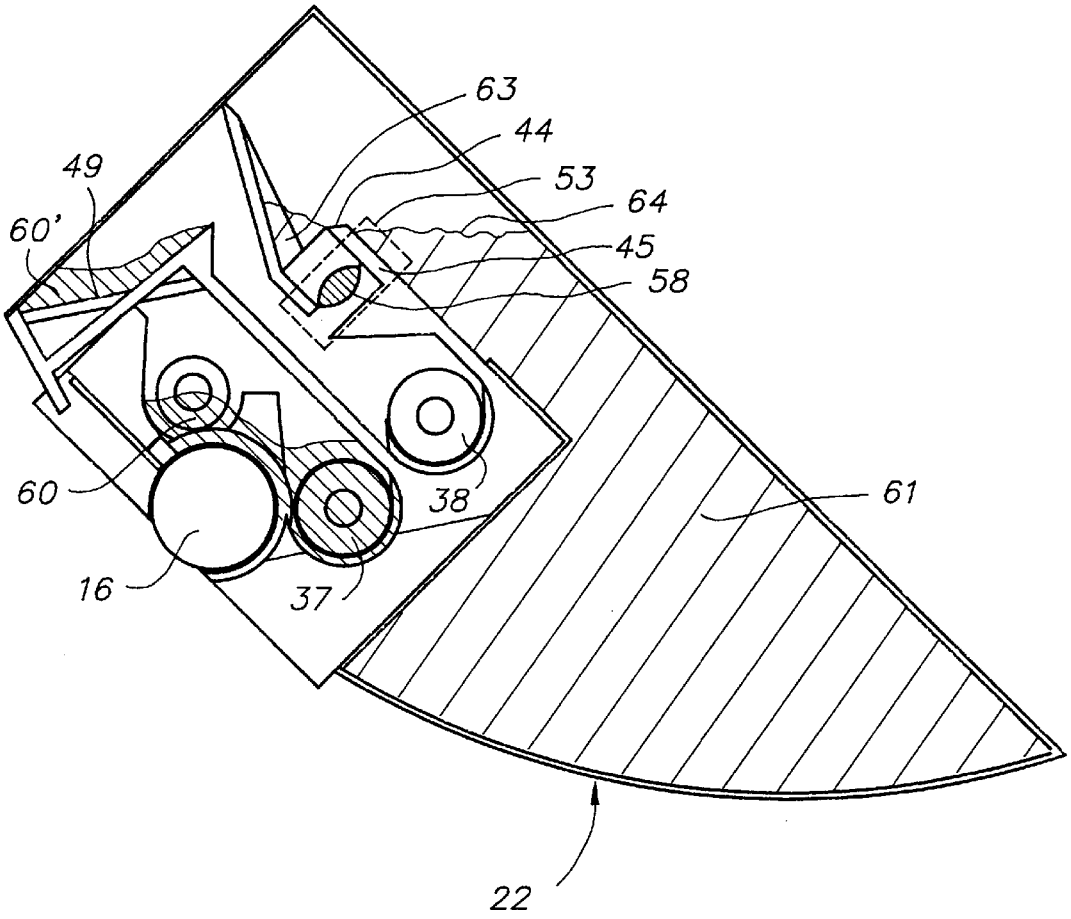
FIG. 13 shows the device of FIG. 7 while rotated over 270 degrees.

FIG. 13 shows the approximately 315° position. Toner 61 flows back towards the lower portion of toner holder 22 so that it now takes a level as indicated by line 64. It is clear that as toner becomes consumed, level 63 will get an ever lower position. The pile of toner on top of dosage reservoir 45 will flow over slanting rim 44 of the reservoir as the device continues its rotation up to 360°.

During the rotation from 315° to 360°, developer 60 resting on slide surface 49 will flow back towards feed screw 38 since its slope gets too steep to keep the developer.

Figure 14:
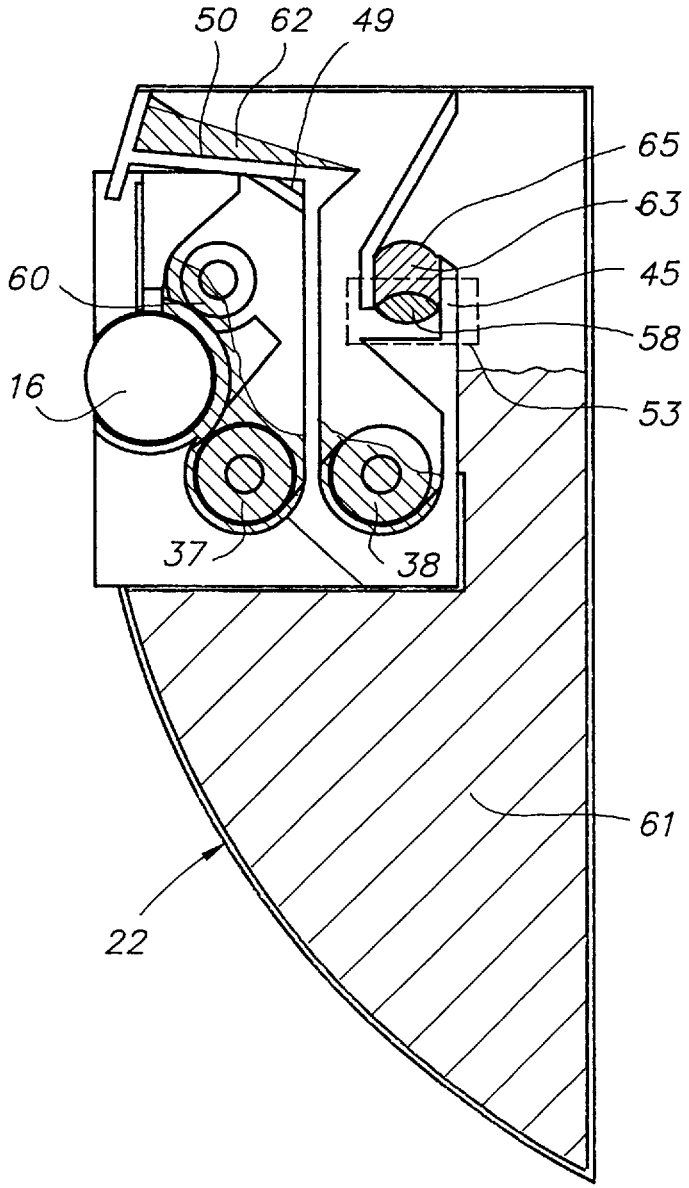
FIG. 14 shows the device of FIG. 7 while rotated over 360 degrees.

FIG. 14 shows the device in its 360° position, or in other words in the developing position. While the largest part of developer has flowed back into the chamber of feed screw 38, developer on slide surface 50 remains in place in the form of a wedge 62 because of the limited slope of this surface. The dose 63 of toner in dosage reservoir 45 takes a shape as illustrated. It has been shown that pile 65 formed on the reservoir has an extremely good reproducible shape, as does the magnetic plug formed in the outlet end of the dosage reservoir, so that the described toner dosage reservoir operates very accurately and reproducibly in practice.

Toner addition is not necessarily required at each development step, and thus operation of the magnet governing the release of toner is not necessarily required at each revolution of the carousel.

Greater control of toner addition can be obtained by using two or more dosage reservoirs in parallel, i.e. located widthwise beside each other.

The described process of filling a toner dosage reservoir, closing it by means of a magnetic plug and emptying it at a desired moment occurs in exactly the same way in the other three developing devices with, however, each time a 90° angular degrees delay.

The present invention is not limited to the described embodiment. A developing device according to the invention must not necessarily be mounted in a carousel but can also be used separately and also stationary. In this case filling of the dosage reservoir can also occur by active means known in the art such as a feed screw, buckets and the like.

Formation and release of the magnetic plug can also occur by the field of an electromagnet.

The function of the magnetic plug can also be accomplished by a conventional mechanical valve.

Emptying the dosage reservoir in the developer can also occur by toppling over the reservoir so that in such case a closeable outlet opening is even not required.

Finally, we refer to our co-pending application entitled "Electrostatic developing device" filed on even day herewith, wherein means is disclosed for completely cleaning a magnet roller at each revolution so that improved development results are obtained.

We claim:

1. An electrostatic developing device comprising:

a housing having an elongated peripheral opening;

a magnetic roller rotatably mounted in said elongated peripheral opening, said magnetic roller having a surface for holding magnetically attractable developer for use in developing an electrostatic image formed on an electrostatic support passed in close proximity to said magnetic roller;

a toner chamber in said housing for holding toner;

a developer chamber in said housing for holding said developer;

means for adding said toner stored in said toner chamber to said developer stored in said developer chamber to form fresh developer, said means comprising a dosage reservoir having an open upper end defined by an upper rim, and a lower end;

means for filling said dosage reservoir with said toner so that when said dosage reservoir is in an upright position, said toner forms a pile having an upper level located above said upper rim; and means for emptying at one time the entire toner contents of said dosage reservoir into said developer chamber to form said fresh developer.

2. An electrostatic developing device according to claim 1, wherein said lower end of said dosage reservoir is open and wherein said means for emptying said entire toner contents of said dosage reservoir comprises a removable magnetic plug located at said lower end of said dosage reservoir and capable of closing said lower end of said dosage reservoir.

3. An electrostatic developing device according to claim 2, wherein said means for emptying said entire toner contents of said dosage reservoir further comprises means for generating a magnetic field traversing said lower end of said dosage reservoir to hold said magnetic plug in place in said lower end of said dosage reservoir.

4. An electrostatic developing device according to claim 3, wherein said means for generating a magnetic field comprises a permanent magnet.

5. An electrostatic developing device according to claim 4, wherein said permanent magnet is movable from a first position proximate to said lower end of said dosage reservoir, wherein said magnetic plug is held in place in said lower end of said dosage reservoir in order to close said lower end of said dosage reservoir, to a second position distal from said lower end of said dosage reservoir, wherein said magnetic plug is released from said lower end of said dosage reservoir to open said lower end of said dosage reservoir.

6. An electrostatic developing device according to claim 3, wherein said magnetic plug is formed out of said developer, and further comprising means for conveying said developer to said lower end of said dosage reservoir so that said magnetic field forms said magnetic plug from said developer.

7. An electrostatic developing device according to claim 6, wherein said means for conveying said developer to said lower end of said dosage reservoir comprises a a first slide surface inclined downward toward said lower end of said dosage reservoir.

8. An electrostatic developing device according to claim 7, wherein said means for conveying said developer to said lower end of said dosage reservoir further comprises a second slide surface inclined downward toward said first slide surface, said second slide surface conveying said developer in a first direction to said first slide surface, said first slide surface conveying said developer in a second direction, said first direction being substantially perpendicular to said second direction.

9. An electrostatographic developing device according to claim 8, wherein said second slide surface further comprises a lip located at an edge of said second slide surface.

10. An electrostatic developing device according to claim 2, wherein said magnetic plug is formed out of said developer.

11. An electrostatic developing device according to claim 1, wherein said means for filling said dosage reservoir with said toner further comprises means for moving said dosage reservoir through said toner.

12. An electrostatic developing device according to claim 11, wherein said means for moving said dosage reservoir further comprises means for moving said dosage reservoir along a circular path in a vertical plane.

13. An electrostatic developing device according to claim 11, wherein said housing is rotatable.

14. A first cylindrical housing rotatable about a horizontal axis, said cylindrical housing having mounted therein at least four electrostatic developing devices spaced circumferentially around said cylindrical housing, each said electrostatic developing device comprising:

a second housing having an elongated peripheral opening;

a magnetic roller rotatably mounted in said elongated peripheral opening, said magnetic roller having a surface for holding magnetically attractable developer for use in developing an electrostatic image formed on an electrostatic support passed in close proximity to said magnetic roller;

a toner chamber in said second housing for holding toner;

a developer chamber in said second housing for holding said developer;

means for adding said toner stored in said toner chamber to said developer stored in said developer chamber to form fresh developer, said means comprising a dosage reservoir having an open upper end defined by an upper rim, and a lower end;

means for filling said dosage reservoir with said toner so that when said dosage reservoir is in an upright position, said toner forms a pile having an upper level located above said upper rim; and means for emptying at one time the entire toner contents of said dosage reservoir into said developer chamber to form said fresh developer.

15. An electrostatic developing device comprising:

a housing having an elongated peripheral opening;

a magnetic roller rotatably mounted in said elongated peripheral opening, said magnetic roller having a surface for holding magnetically attractable developer for use in developing an electrostatic image formed on an electrostatic support passed in close proximity to said magnetic roller;

a toner chamber in said housing for holding toner;

a developer chamber in said housing for holding said developer;

means for adding said toner stored in said toner chamber to said developer stored in said developer chamber to form fresh developer, said means comprising at least two dosage reservoirs, each said dosage reservoir having an open upper end defined by an upper rim, and a lower end;

means for filling each said dosage reservoir with said toner so that for each said dosage reservoir, when said dosage reservoir is in an upright position, said toner forms a pile having an upper level located above said upper rim of said dosage reservoir; and for each said dosage reservoir, means for emptying at one time the entire toner contents of said dosage reservoir into said developer chamber to form said fresh developer.

16. An electrostatic developing device according to claim 15, wherein said means for filling each said dosage reservoir fills said dosage reservoirs with different quantities of said toner.

* * * * *